US005115415A

United States Patent [19]

Mumby et al.

[11] Patent Number: 5,115,415

[45] Date of Patent: May 19, 1992

[54] STEPPER MOTOR DRIVEN NEGATIVE PRESSURE PULSE GENERATOR

[75] Inventors: Edward S. Mumby; Kevin J. Shinneman, both of Houston, Tex.

[73] Assignee: Baker Hughes Incorporated, Houston, Tex.

[21] Appl. No.: 665,310

[22] Filed: Mar. 6, 1991

[51] Int. Cl.[5] ..... G01V 1/40

[52] U.S. Cl. ..... 367/85; 367/83

[58] Field of Search ..... 367/83, 85; 340/861

[56] References Cited

U.S. PATENT DOCUMENTS 3,983,948 10/1976 Jeter ..... 367/85
3,997,867 12/1976 Claycomb ..... 367/83
4,386,422 5/1983 Mumby et al. ..... 367/85
4,825,421 4/1989 Jeter ..... 367/83
4,837,753 6/1989 Morris et al. ..... 367/86
4,839,870 6/1989 Scherbetskoy ..... 367/85

*Primary Examiner*—Ian J. Lobo
*Attorney, Agent, or Firm*—Christie, Parker & Hale

[57] ABSTRACT

Variable control of the stroke and timing of the poppet in a pressure pulse generator system provides desired control for varying down hole conditions. A stepper motor interconnected to the poppet provides variable acceleration and variable position for the poppet under the control of a motor controller and motor driver which establish the number of steps and timing of steps for the motor. Various valve position profiles are provided in a memory for specific stroke and acceleration operation of the valve under varying down hole conditions and signaling requirements.

9 Claims, 9 Drawing Sheets

Fig. 7
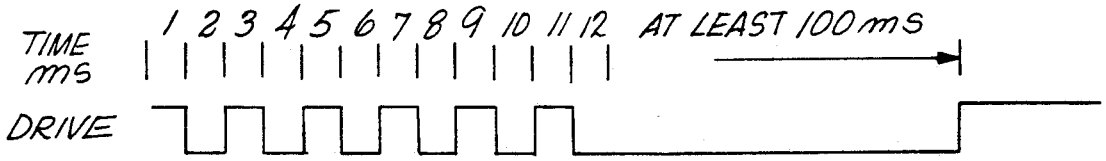
Fig. 8a
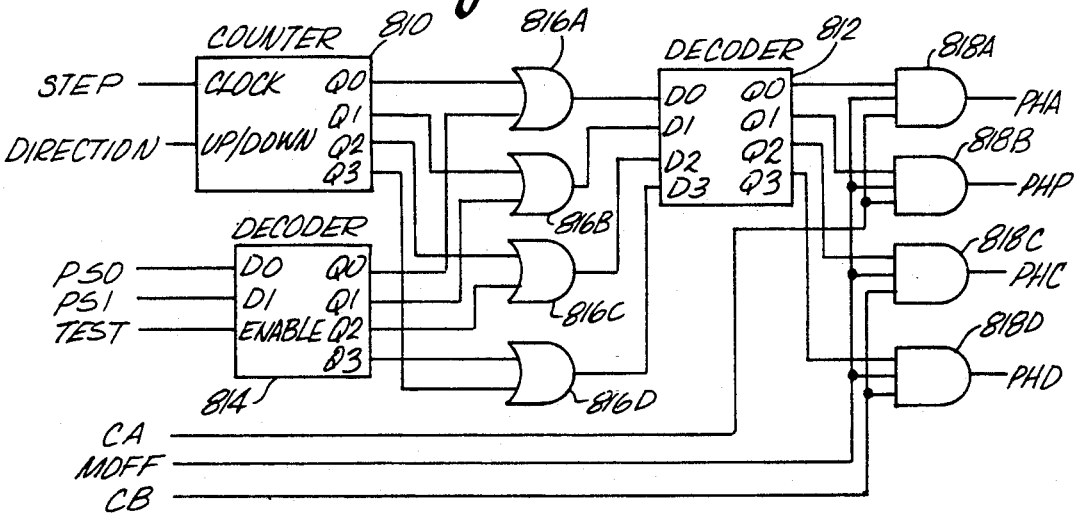
Fig. 8b
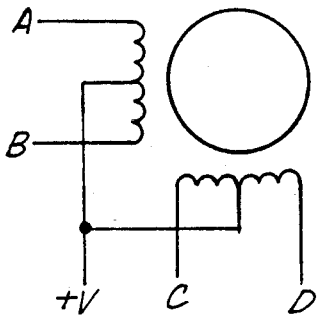
Fig. 8c
| MOTOR PHASES | | | |
|---|---|---|---|
| A | B | C | D |
| 1 | 0 | 1 | 0 |
| 0 | 0 | 1 | 0 |
| 0 | 1 | 1 | 0 |
| 0 | 1 | 0 | 0 |
| 0 | 1 | 0 | 1 |
| 0 | 0 | 0 | 1 |
| 1 | 0 | 0 | 1 |
| 1 | 0 | 0 | 0 |
KEY
1 = PHASE ON
0 = PHASE OFF

STEPPER MOTOR DRIVEN NEGATIVE PRESSURE PULSE GENERATOR

BACKGROUND OF THE INVENTION

1. Field of the Invention

This invention relates to logging wells during drilling, and more particularly to the wireless telemetry of data related to downhole conditions.

2. The Prior Art

It has long been the practice to log wells by sensing various downhole conditions within a well and transmitting the acquired data to the surface through a wireline or cable-type equipment. To conduct such logging operations, drilling is stopped, and the drill string is removed from the well. Since it is costly and time-consuming to remove the drill string, the advantages of logging-while-drilling, or at least without removing the drill string from the well bore, have long been recognized. However, the lack of an acceptable telemetering system has been a major obstacle to successful logging-while-drilling.

Various systems have been suggested for logging-while-drilling. For example, it has been proposed to transmit data to the surface electrically through wires. Such methods have been impractical because of the need to provide the drill string sections with a special insulated conductor and appropriate connections for the conductor at the drill string joints. If a steering tool is used for directional drilling, and is controlled by wires from the surface, the wires and tool must be withdrawn from the well before continuing drilling in the rotary mode. Other proposed techniques include the transmission of acoustical signals through the drill string. Examples of such telemetering systems are shown in U.S. Pat. Nos. 3,015,801 to Kalbfell and 3,205,477 to Richards. In those systems, an acoustical signal is sent up the drill string and frequency modulated in accordance with a sensed downhole condition.

Wireless systems have also been proposed using low-frequency electromagnetic radiation through the drill string, borehole casing, and the earth's lithosphere to the surface of the earth.

Other telemetering procedures proposed for logging-while-drilling use the drilling fluid within the well as a transmission medium. U.S. Pat. Nos. 2,759,143 and 2,925,251 to Arps and 3,958,217 to Spinnler disclose systems in which the flow of drilling fluid through the drill string is periodically restricted to send positive pressure pulses up the column of drilling fluid to indicate a downhole condition. U.S. Pat. Nos. 2,887,298 to Hampton and 4,078,620 to Westlake et al disclose systems which periodically vent drilling fluid from the drill string interior to the annular space between the drill string and the well borehole to send negative pressure pulses to the surface in a coded sequence corresponding to a sensed downhole condition. A similar system is described in U.K. Patent Publication No. 2,009,473 A (Scherbatskoy).

A general problem with using pressure-pulsing equipment in a drill string to send information through the drilling fluid is that the pulse generators to date have been bulky and, therefore, impose a wasteful pressure drop in the drilling fluid flowing through the drill string. Moreover, the previous pulse generators require a relatively large amount of electrical power, which means short operating time if batteries are used. The previous pulse generators also tend to plug when the drilling fluid includes lost circulation material (LCM), and are subject to excessive wear, resulting in short service life and frequent failure under operating conditions.

In addition, some of the prior art pulse generators require specially built drill collars in the drill string to receive the generators and cannot reliably be positioned in the lower end of the drill string without removing the drill string from the well bore.

U.S. Pat. No. 4,550,392 to Mumby discloses an improved pressure pulse generator which overcomes many of the disadvantages of the prior art. However, we have found that the pressure pulse generator shown in that patent is sometimes subjected to excessive vibration, which shortens its service life.

The present invention provides an improved pressure pulse generator less subject to vibration or problems with LCM and, therefore, with a longer and more reliable service life.

Another advantage of the present invention is that when it is in operating position in the drill string, it offers a relatively low resistance to flow of drilling fluid, and is more tolerant of LCM, which is sometimes added to the drilling fluid for well control.

The pulse generator of the invention can be used to transmit data which measures many different downhole conditions, such as electrical resistivity, radioactivity, temperature, drilling fluid flow rate, weight-on-bit, torque, and the like. It is also well suited for directional survey work, i.e., determining the inclination and azimuth of a borehole. Such information is important for ascertaining that the well is being accurately drilled to a selected downhole position.

SUMMARY OF THE INVENTION

The negative stepper pulser is a valve assembly and drive system packaged in an elongated housing adapted to fit within a drill string downhole near the drill bit. High pressure drilling fluid circulated by a pump through the interior of the drill string past the negative pressure pulser and out through the drill bit into the well bore provides the working medium for the present invention. The valve assembly in an open position allows communication through the drill string wall between a region of high pressure drilling fluid inside the drill string and a region of lower pressure drilling fluid in the well bore. This communication allows pressure pulses to be generated. The pulser valve includes a poppet and seat. Withdrawal of the poppet from the seat allows high pressure drilling fluid to pass through the valve into an exit nozzle in the drill string to the well bore. The poppet incorporates an axial bore through which the drilling fluid passes to an interior chamber. Sealing means for the poppet having slightly larger diameter than the contact diameter between the poppet and seat causes the drilling fluid to urge the poppet downwardly against the seat.

Actuation of the valve poppet is accomplished using a stepper motor connected to the poppet through a rotary to linear motion convertor. Electronic control means for the stepper motor provides programmable actuation of the valve to allow variation in acceleration, velocity, and displacement of the poppet to tailor the shape and duration of pressure pulses created by the valve. Control of the poppet displacement allows larger displacement "clearing pulses" to allow passage of LCM or contaminants through the valve.

BRIEF DESCRIPTION OF THE DRAWINGS

FIG. 7 is depiction of the DRIVE signal for issuing commands to the stepper motor controller.

FIG. 8A is a logic diagram of the programmable logic device (PLD) of the stepper motor controller.

FIG. 8B is a schematic representation of the stepper motor drive coils.

FIG. 8C is a table demonstrating the motor phases.

DESCRIPTION OF SPECIFIC EMBODIMENTS

Figure 1:
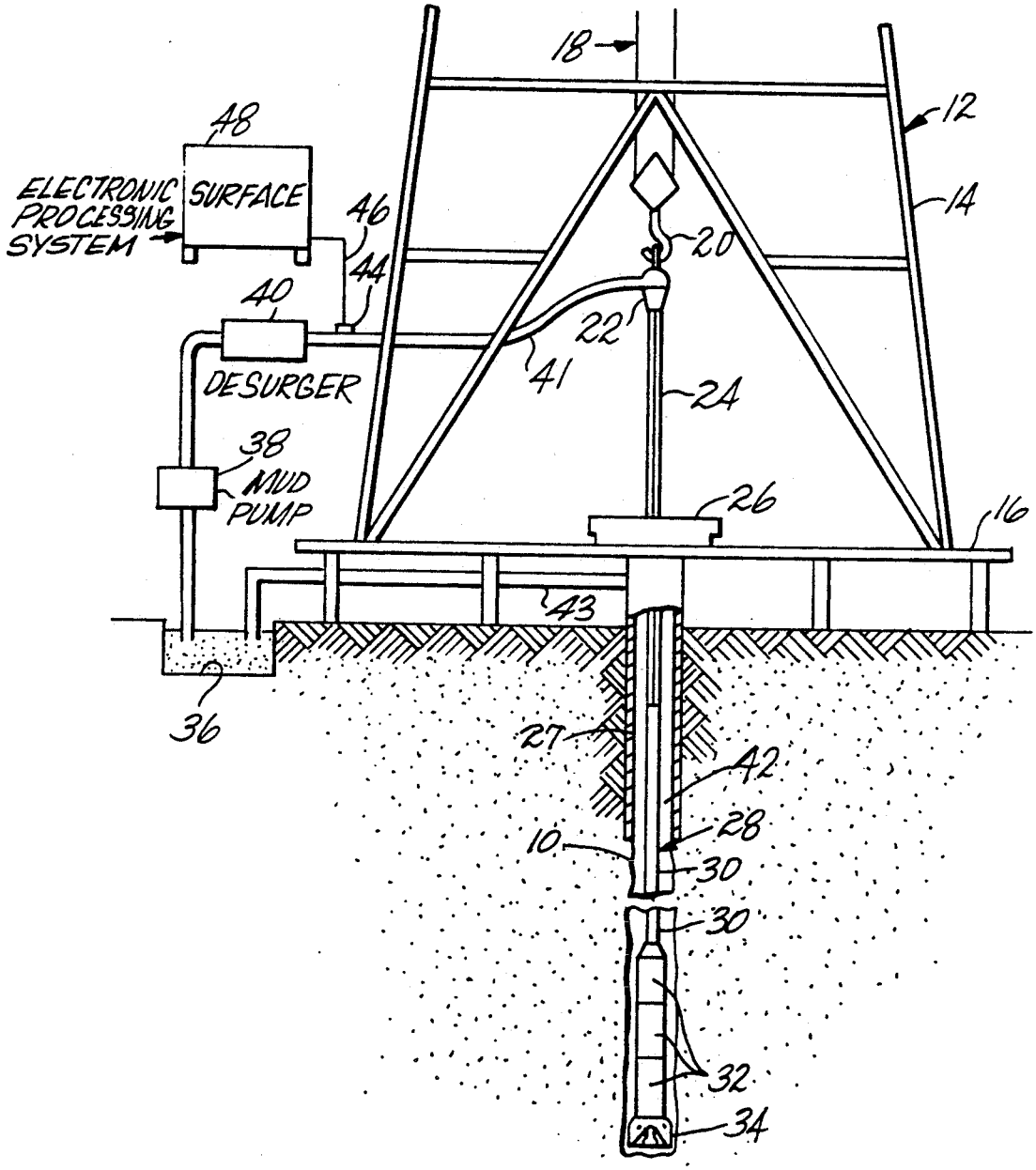
FIG. 1 is a fragmentary schematic elevation of a drilling rig and system for logging a well with a drill string in it.

Referring to FIG. 1, a well 10 is drilled in the earth with a rotary drilling rig 12, which includes the usual derrick 14, derrick floor 16, draw works 18, hook 20, swivel 22, kelly joint 24, rotary table 26, casing 27, and a drill string 28 made up of sections of drill pipe 30 secured to the lower end of the kelly joint 24 and to the upper end of a section of drill collars 32, which carry a drill bit 34. Drilling fluid (commonly called "drilling mud" in the field) circulates from a mud pit 36 through a mud pump 38, a desurger 40, a mud supply line 41, and into the swivel 22. The drilling mud flows down through the kelly joint, drill string and drill collars, and through nozzles (not shown) in the lower face of the drill bit. The drilling mud and formation cuttings flow back up through an annular space 42 between the outer diameter of the drill string and the well bore to the surface, where it returns to the mud pit through a mud return line 43. The usual shaker screen (not shown) separates formation cuttings from the drilling mud before it returns to the mud pit.

A transducer 44 in the mud supply line 41 detects variations in drilling mud pressure at the surface. The transducer generates electrical signals responsive to drilling mud pressure variations. These signals are transmitted by an electrical conductor 46 to a surface electronic processing system 48.

Thus, as described in detail below, pressure pulses may be transmitted through the drilling fluid to send information from the vicinity of the drill bit on the lower end of a drill string in a well to the surface of the earth as the well is drilled. At least one downhole condition within the well is sensed, and a signal is generated to represent the sensed condition. The signal controls the flow of drilling fluid in the drill string to cause pressure pulses at the surface in a coded sequence representing the downhole condition.

Figure 2:
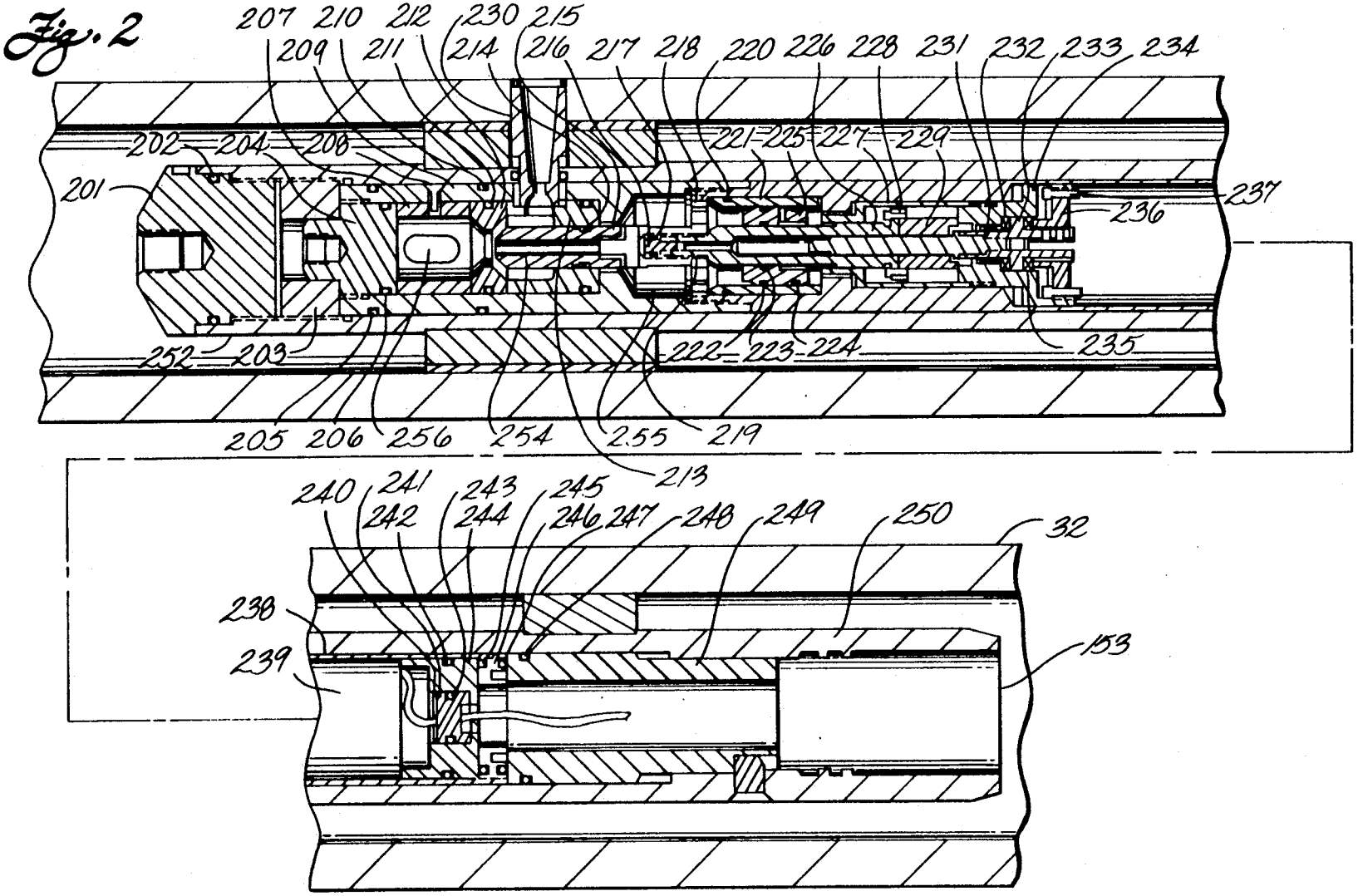
FIG. 2 is a sectional elevation of the preferred embodiment of a pulse generator assembly made in accordance with this invention, and mounted in operating position in a drill string.

Referring to FIG. 2, an elongated, cylindrical pressure pulse generator assembly is mounted in a housing 250 substantially coaxially in a drill collar 32 so the lower end portion 252 of the assembly rests above the drill bit.

The pulser assembly is in two main sections. First the section includes the valve housing 209 that encases valve 215 and seat 212. The second section includes the motor housing 238 that houses the stepper motor 239, ball screw 229, and convertor stem 226. The two sections thread together to form a single unit.

The motor housing is sealed at the lower end by a lock nut 246 with two elastomeric seals 247 and 245. Seal 247 rests against a stress bulwark 249 that is used to take the load of the inner assembly and to allow room for electrical wires to enter either from the side (not shown) or from the top of the housing 253. Another elastomeric seal 248 is located in a groove along the surface of the stress bulwark and forms a fluid-tight seal with the assembly housing 250. The lock nut 246 threads into the motor housing 238 and abuts against a bulkhead retainer 244 which holds an electrical glass-to-metal feed through connector 241. The connector 241 is sealed by an O-ring 243 and retained by a retaining ring 240. An additional O-ring 242 is located in a groove along the outside surface of the bulkhead retainer to form a fluid-tight seal with the motor housing 238.

The bulkhead retainer 244 rests against the backside of the stepper motor 239. An adapter 236 is bolted to the front side of the motor 239 by four screws 237. This allows a bearing housing 234 to be threaded onto the motor adapter 236. Inside the bearing housing 234 are three sets of bearings; a roller needle bearing 231, and two sets of thrust bearings 232 and 235, respectively. The bearings support a shaft 233 that slides over the motor output shaft (not shown). The bearings prevent any axial load from being applied to the motor shaft. A flat on the motor shaft engages a corresponding feature on the bearing shaft to transmit radial torque.

A ball screw assembly 229 is threaded into the bearing shaft 233. The assembly consists of a precision ground screw thread that supports a nut by way of recirculating ball bearings. The nut has a flange that allows a converter stem 226 to be bolted to it by fasteners 228. The converter stem has a hexagonal section that slides through a hexagonal hole of a converter bushing 227. The bushing threads onto the bearing housing 234. The converter stem 226 slides through a floating piston 225. The piston 225 seals against the stem by a T-seal 223 and against a liner 221 by another T-seal 222 and a support O-ring 224. The liner 221 is held in place in the motor housing 238 by a retainer nut 218. The liner is a replaceable item that prevents wear on the motor housing. An additional O-ring 220 fits in a groove in the outside surface of the liner 221 to form a fluid-tight seal between the liner and motor housing.

The floating piston 225 separates drilling mud which enters through a valve on the left of the piston from lubricating oil on the right side of the piston used to lubricate the components contained in the motor housing. The oil lubricates the bearings and ball screw assembly and provides pressure balancing across the thin wall of the motor housing.

The converter stem 226 protrudes out of the motor housing and is sealed on the left downhole side by an oil plug 216. This plug is removed to allow the assembly to be charged with oil. After the plug is installed and seals off the lubricating oil by an O-ring 217, a valve poppet 215 is threaded onto the stem 226. The valve poppet is measured for proper stroke and locked into place by a jam nut 219. The valve poppet slides through a guide 213 in the valve housing 209 and is supported by a T-seal 214. The valve guide 213 supports an exit nozzle 230 and a valve seat 212. The valve seat 212, which is sealed by an O-ring 211, supports an inlet spacer 207. The spacer 207 is located by a screw 208. The valve housing 209 is sealed at the downhole end by an end plug 204 and an O-ring 206 which abuts against the spacer 207. A lock nut 203 holds the inner assembly securely in place inside the housing 250. Additional O-rings 210 and 205 are located in grooves along the outer surface of the valve housing and form a fluid-tight seal with the assembly housing 250. A bullnose 201 seals the downhole end of the assembly housing with an internal threaded connection and a sealing O-ring 202.

To create negative pressure pulses, the valve poppet is pulled upwardly off of the seat to allow drilling mud to pass from the inlet ports of the spacer 207 past the seat 212 and into the valve guide 213 and then out to the annulus of the well by way of the exit nozzle 230. The valve is then driven downwardly against the seat to seal off the flow of the drilling mud to return the pressure in the well to normal. As the valve opens and closes, the pressure in the drilling mud at the surface decreases, and transducer 44 detects that pressure change. By coding the sequence of the pressure pulses transmitted to the surface, information corresponding to the value of the downhole property being measured can be determined without having to remove the drill string from the well.

In order to drive the valve, electrical commands are given to the stepper motor to rotate clockwise. This causes the ball screw shaft 229 to rotate by way of the bearing shaft 233. The ball screw nut 229 is attached to the converter stem 226 which has its hexagon portions sliding through the hexagonal hole of the bushing 227. As the ball screw rotates clockwise, the ball nut is prevented from rotating by the hexagonal portion of the stem 226. In this manner, the rotational motion of the motor 239 is converted to axial motion of the ball screw nut 229, which drives the valve poppet 215. When the motor turns counterclockwise, the valve poppet is pushed downwardly against the seat 212.

The valve poppet 215 has a large axial bore 254 which allows drilling mud at substantially the same pressure as at the inlet ports 256 to be transferred to the uphole side of the valve seal 214. The valve seal diameter is slightly larger than the contact diameter where the poppet hits the seat. This causes the poppet valve always to be urged downwardly and to be held against the seat without assistance from the motor. The pressure uphole of the valve seal is always greater than the pressure downhole of the seal inside the valve guide. The differential pressure is greatest when the valve is in close proximity to the seat and is reduced the farther the valve is drawn away from the seat. The valve is capable of operating with LCM in the drilling mud without clogging.

As previously described a stepper motor is employed to actuate the valve poppet in the pulser assembly. An electronic control means is provided to operate the stepper motor to achieve the desired displacement or stroke, the acceleration and the velocity of the poppet to achieve the desired pulse shape and duration. Operation of data sensors in the drill string and calculation of the information to be transmitted by the pressure pulser assembly is typically controlled by a downhole processor. An example of this type of system is disclosed in U.S. Pat. No. 4,216,536 to More. This downhole processor, which for use with the embodiment of the present invention to be described subsequently is an RCA1802 or HPCL16003, provides a signal to the electronic control means for activation and control of the pulser.

Figure 3:
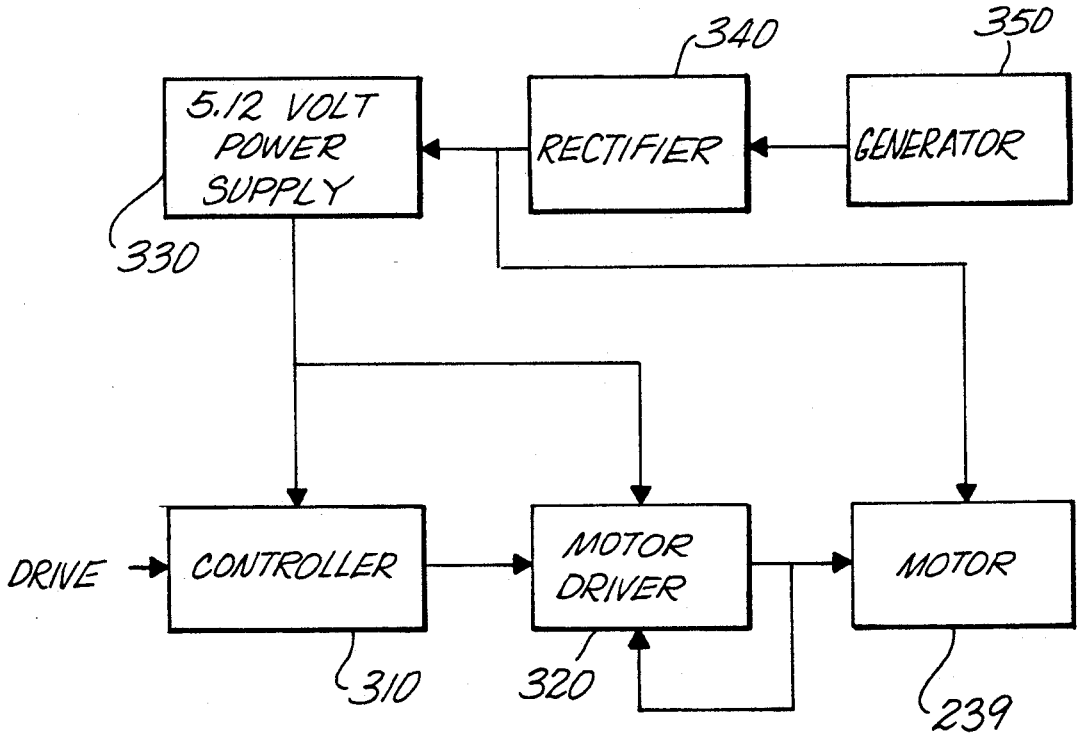
FIG. 3 is a block diagram of the electronic control system and power supply for the negative stepper pulser.

FIG. 3 demonstrates a generalized arrangement for the present invention wherein the signal from the downhole processor is designated DRIVE which is provided to a stepper motor controller 310. The stepper motor controller converts the drive signal from the downhole processor to control signals for a motor driver 320 which physically drives the stepper motor 239. Power for the stepper motor controller and stepper motor driver is provided by a power supply 330 which in the present embodiment provides +5 volt and +12 volt dc power. In the embodiment shown in the drawings the power supply is in turn powered by a rectifier 340 receiving input from a downhole generator 350. Actuation power for the motor is provided from the rectifier.

The motor driver switches the motor phase windings on and off in the required sequence to move the motor clockwise or counter clockwise as determined by a direction input from the stepper motor controller. The motor driver regulates the phase current for each activated phase of the motor.

Figure 4:
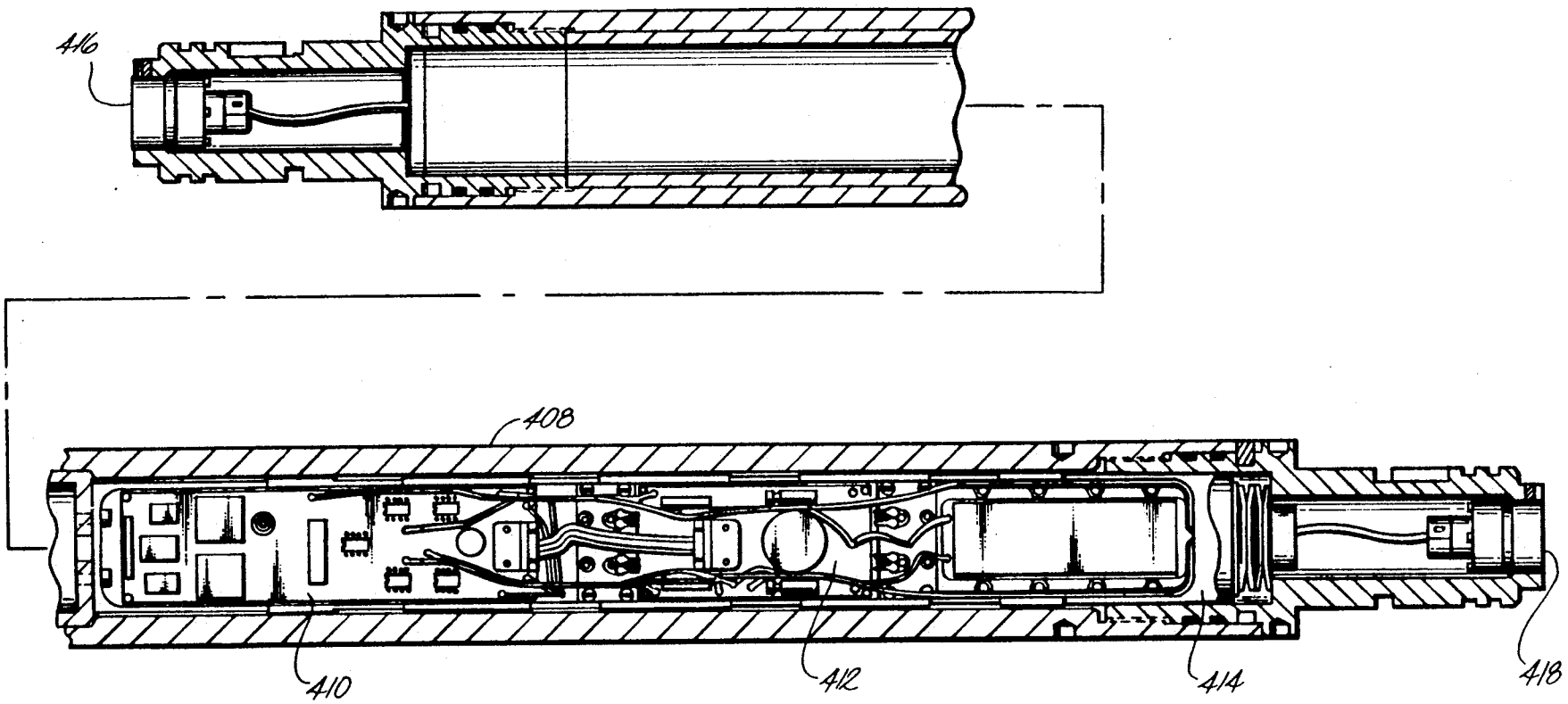
FIG. 4 is a schematic representation of a sectional elevation of the electronic control assembly.

FIG. 4 provides a schematic representation of the present embodiment of the invention which distributes the control and motor drive circuitry as two assemblies housed in a single sub 408. A first printed circuit board assembly 410 incorporates the stepper motor controller while a second circuit board assembly incorporates the stepper motor field effect transistor (FET) module 412 which acts as the driver for the stepper motor. The FET module carries the high power switching transistors for motor phase switching. The described embodiment is employed to permit the electronics assembly to be mounted on shock and vibration absorptive material yet permit the heat generating components to be attached to the H-channel 414 as shown in FIG. 4 for the best possible heat sink. Segregation of the power components also provides greater serviceability since power transistors are more likely to fail than the other components. Connector 416 attaches the circuitry to the stepper motor through a mating connector (not shown) and connector 240. Connector 418 attaches the generator system to be described subsequently.

Figure 5:
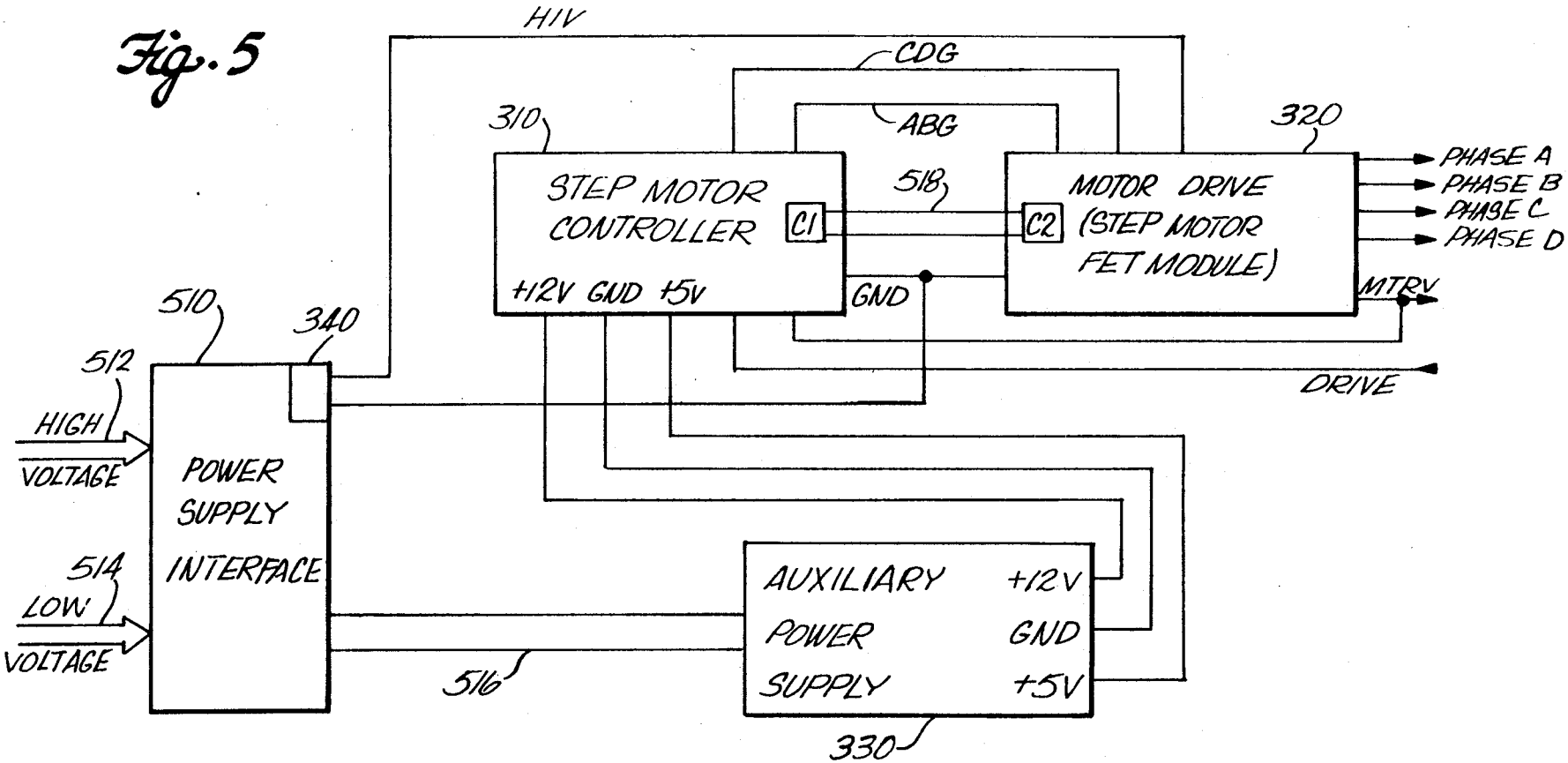
FIG. 5 is a schematic representation of the power supply stepper motor controller and stepper motor FET module.

As previously described the generator provides power to operate the electronic control means. As shown in FIG. 5 high voltage is provided to the power supply interface 510 through input 512 while low voltage is provided to the power supply interface through input 514. Low voltage power is provided through various transformer circuits in the power supply interface to the auxiliary power supply 330 through bus 516. The auxiliary power supply provides precision +12 volt and +5 volt power to the stepper motor controller 310.

The power supply interface provides high voltage power through rectifier 340 to the motor driver (stepper motor FET module) 320. Signals from the stepper motor controller to the stepper motor FET module are provided on strip cable 518 between connectors on the two printed circuit boards. System grounding, ABG and CDG, for the phase current regulation to the windings of the motor are provided from the stepper motor controller to the stepper motor FET module. The control signals will be described in greater detail subsequently.

As described previously, the DRIVE signal provided by the downhole processor to the stepper motor controller provides actuation and control of the system. The stepper motor FET module provides four signals PHASE A, PHASE B, PHASE C, and PHASE D to the windings of the stepper motor. Motor voltage is provided by the MTRV signal which is also fed back for low voltage monitoring to the stepper motor controller.

Figure 6:
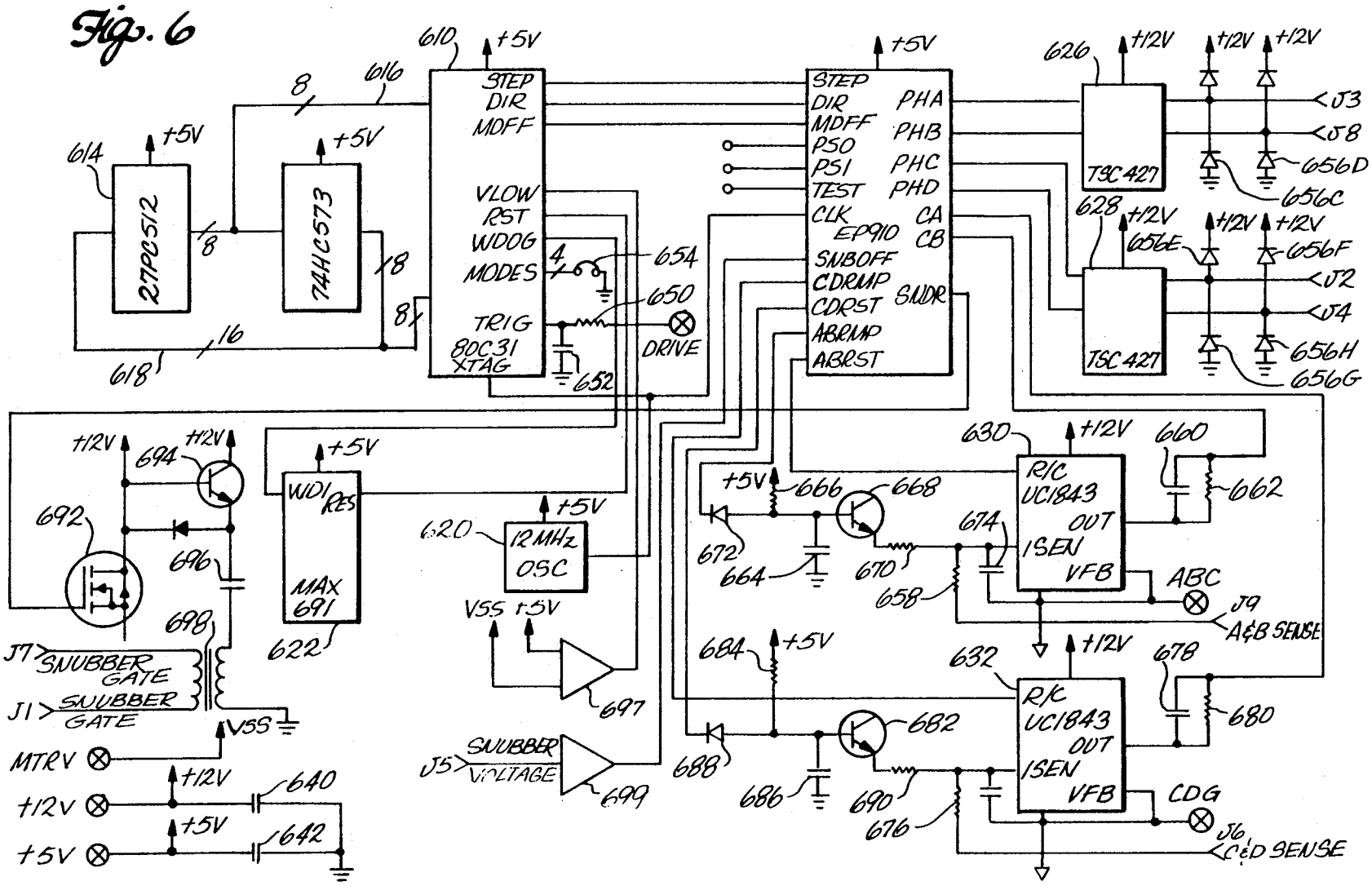
FIG. 6 is a detailed schematic of the stepper motor controller.

Details of the stepper motor controller are best seen in FIG. 6. A micro-controller 610 receives the DRIVE signal from the downhole processor. The input signal is filtered by resistor 650 and capacitor 652. In a preferred embodiment the micro-controller is an Intel 80C31.

As shown in the drawings the micro-controller has a multiplex address/data bus, therefore, a latch 612 is required to interface with the memory 614. In the preferred embodiment the address latch is a 74HC573. Various memories may be employed to provide operating information for various valve profiles including velocity, acceleration, and displacement of the poppet. In the embodiment shown, a Texas Instruments TMS27PC512 SML-25 One Time Programmable Read Only Memory is used. An 8 bit data bus 616 is employed to interconnect the memory and latch to port 0 of the micro-controller. A 16 bit address bus 618 connects the memory, the latch and port 2 of the micro-controller to provide addressing for the memory. In the embodiment shown bits 0 through 7 of the address are loaded from port 0 on the micro-controller through the latch using the data bus while bits 8 through 16 of the address are loaded to the memory directly from port 2 of the micro-controller. Those skilled in the art will recognize numerous addressing options for various micro-controller and memory combinations.

The micro-controller in the preferred embodiment operates at 12 MHz. A 12 MHz oscillator 620 is provided to clock the processor and other circuitry to be described subsequently. In the embodiment shown in the drawings a secondary timer is provided for reset timing and protection against failures due to program "crash". In the preferred embodiment a Maxim "693" Watch Dog Timer 622 is employed.

In addition to the DRIVE signal providing control input for the micro-controller which enters on the trigger (TRIG) input, four inputs, MODES, selectable by jumpers 654, are provided for addressing various valve position profiles and modes of valve operation. In the embodiment shown in the drawings the TRIG and MODES signals are provided through port 3 of the micro-controller.

Selection of valve position profile dynamically is accomplished using the DRIVE signal. In the present embodiment the number of times the drive signal is toggled from +5 volts to ground and back selects the number of the valve position profile. An example of the toggling drive signal is shown in FIG. 7. In the present embodiment the drive signal must be held low for one millisecond for the micro-controller to recognize a selection pulse. Shown in FIG. 7 is a selection of the fifth valve profile. Default selection of a valve profile is accomplished using three of the jumpers providing input to the MODES inputs of the micro-controller. Three bits provide selection of up to 7 valve profiles. The fourth jumper bit selects one of two modes for valve operation. A hold open mode and an open/close mode. In the hold open mode the valve is opened using the selected valve profile and remains open until the DRIVE signal is returned to a high state. In the open/close mode of operation the valve opens using the selected profile and then immediately closes using the selected profile upon receiving a DRIVE low signal.

The micro-controller provides outputs on port 1 based on the valve position profiles selected from memory by the control signals on port 3. Output information includes step signal STEP and direction signal DIR for physical operation of the stepper as will be described in greater detail subsequently. A motor on/off command MOFF is also provided. The control outputs from the micro-controller are connected to a programmable logic device 624 which controls the motor phase switching. In the preferred embodiment the programmable logic device is an Altera EP910.

As shown in FIG. 7 the DRIVE signal must remain low for at least 100 milliseconds for the controller to recognize an activation signal for the valve. The number of STEP signals and the sense of the DIR signal provided by the micro-processor to the programmable logic device are determined by the valve profile. The DIR signal provides the direction of stepping for the motor and the number of STEP signals issued by the micro-controller determines the number of steps taken by the motor in direction indicated.

A logic diagram demonstrating the operation of the programmable logic device is shown in FIG. 8A. The ultimate requirement of the outputs of the programmable logic device which are designated PHA, PHB, PHC, and PHD is to provide control of motor phase switching and timing signals for regulation of the motor phase current. The stepper motor is configured as shown in FIG. 8B having winding inputs A, B, C, and D. The desired output of the logic device is shown in the table of FIG. 8C wherein a 1 designates a "switched on" condition applied to the corresponding input on the motor windings and a 0 implies a "switched off" input. The internal operation of the programmable logic device as shown in FIG. 8A is accomplished using a counter 810 receiving the step and direction control signals from the micro-controller. The step signal provides the clocking for the counter while the direction signal determines if the count is up or down. The four bits of output from the counter are provided to a decoder 812. In the present embodiment a test circuit comprising a second decoder 814 having four outputs combined with the outputs of the counter through four gates 816A through 816D is provided. A TEST input enabling the decoder and two bits of input, PS0 and PS1, allow selection of a high output on each phase signal. The four bit output of decoder 812 is provided to four AND gates 818A through 818D. ANDed with the decoded motor phase signal are the MOFF signal for motor on off control received from the micro-controller and phase current regulation signals CA for phases A and B and CB for phases C and D. The outputs of the and gates provide signals PHA, PHB, PHC, and PHD which are then provided to the motor driver which comprises the step motor FET module as previously described.

Figure 9:
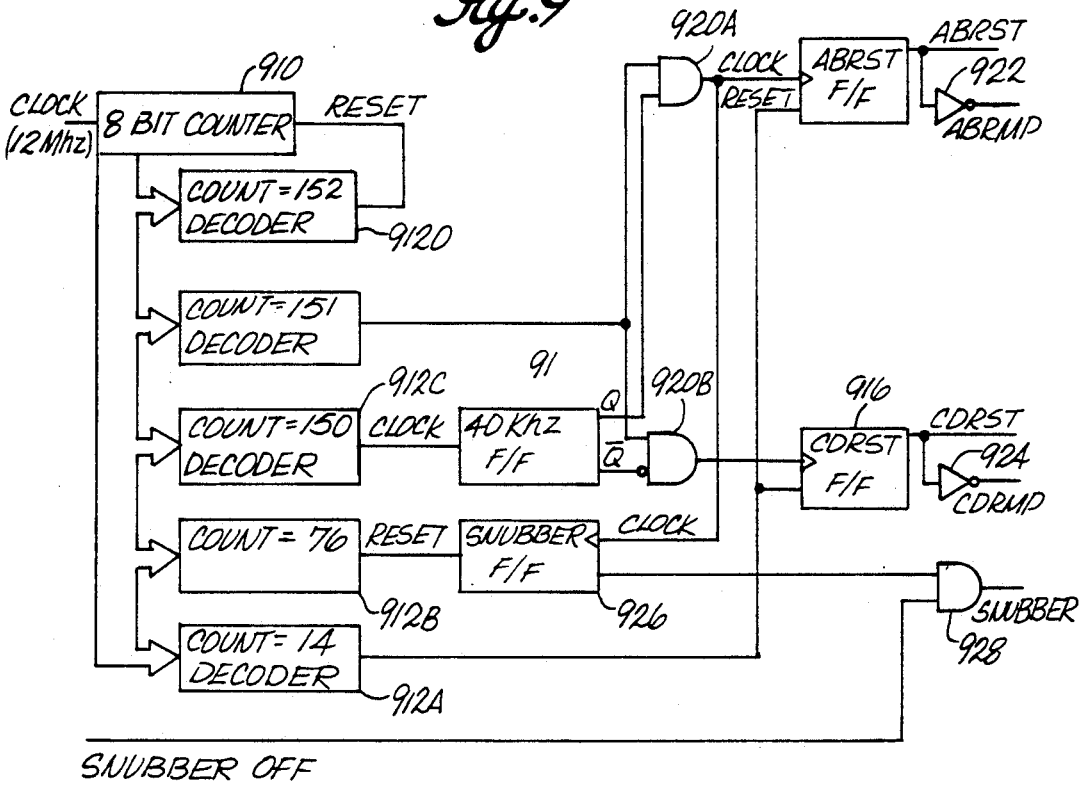
FIG. 9 is a logic diagram for the motor phase current regulation circuitry of the stepper motor controller.

Motor phase current regulation is accomplished using control signals CA and CB, however, additional timing circuitry is required in the programmable logic array for proper control. In the embodiment shown four signals comprising 1.2 micro second pulses spaced 25 milliseconds apart are required. To accomplish this the programmable logic device receives a clock input from the 12 MHz oscillator and provides circuitry having logic functions as shown in FIG. 9. An 8 bit counter 910 receives the 12 MHz clock input. Decoders 912A through 912E receive the 8 bits from the counter and decode counts 14, 76, 150, 151, and 152 respectively. The output of decoder 912A corresponding to count 14 is provided to a first flip flop 914 and a second flip flop 916 as a reset signal. Decoder 912C representing count 150 provides the clock input to a 40 Khz flip flop 918. The output and inverting output of flip flop 918 are provided to AND gates 920A and 920B. The second input to AND gates 920A and 920B is provided from decoder 912D at count 151. Outputs of AND gates 920A and 920B provide clock signals for flip flops 914 and 916 respectively. Flip flop 914 provides the A/B phase reset signal ABRST or through invertor 922 the A/B current ramp signal ABRMP. Similarly flip flop 916 provides the C/D phase reset signal CDRST or through invertor 944 the C/D phase ramp signal CDRMP.

A snubber flip flop 926 receives a reset signal at count 76 from decoder 912B. The snubber flip flop is clocked at count 151 from the output of and gate 920A. The output of the snubber flip flop is ANDed at gate 928 with a SNUBBER OFF signal which will be described in greater detail subsequently to provide the snubber signal output. The final decoder 912E provides a reset signal for the 8 bit counter at count 152.

Figure 10:
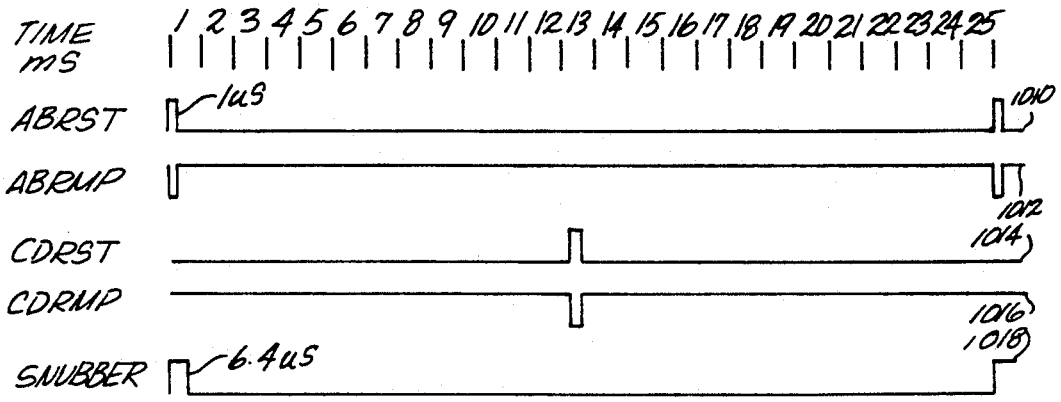
FIG. 10 is a timing diagram for the motor phase current regulation and snubbing.

The timing signals output from the logic in the programmable logic array device shown in FIG. 9 are shown in FIG. 10. The ABRST and ABRMP signals occur at the same time and are 180 degrees out of phase with the CDRST and CDRMP signals. The 40 Khz flip flop driven by the count decoder 912C, which effectively divides the 12 MHz clock by 150 to produce an 83 nanosecond pulse every 12.5 milliseconds, results in a 50% duty cycle 40 Khz square wave. ANDing of this square wave with the output of decoder 912D at count 151 clocks the ABRST flip flop 914 which is then reset when the count reaches 14 by decoder 12A. This results in a 1.2 microsecond pulse every 25 milliseconds. Signals ABRST and ABRMP are shown as signals 1010 and 1012 respectively. Similarly employing the inverted output of the 40 Khz flip flop the CDRST flip flop 916 is clocked and reset to produce the CDRST and CDRMP signals 12.5 milliseconds later. Signals CDRST and CDRMP are shown as signals 1014 and 1016 in FIG. 10 respectively.

Clocking of the snubber flip flop 926 at count 151 through and gate 920A driven also by the 40 Khz flip flop and resetting the snubber flip flop at count 76 by decoder 912B provides a 6.4 microsecond pulse every 24 milliseconds. The resulting output is demonstrated in FIG. 10 as signal 1018.

In the present embodiment, the output of the programmable logic device for the phase control signals PHA through PHD are conditioned using drivers 626 and 628. In the preferred embodiment the drivers employed are TSC427 chips. The drivers are protected from "latch up" by diodes 656A through 656H.

The ABRST, ABRMP, CDRST, and CDRMP signals from the programmable logic device are used to regulate current in the motor phase pairs AB and CD employing regulators 630 and 632 of FIG. 6 respectively. As shown in FIG. 8C only one motor phase per pair is switched on at any one time. Therefore, two regulators provide sufficient circuitry. In the embodiment shown in the drawings the regulation circuit is a Unitrode Model UC1843 current mode PWM controller. Current sensed from the A/B windings is provided as signal A&BSENSE. The current is sensed across a 0.1 ohm resistor 658 in the embodiment shown in the drawing. In that embodiment at maximum rate of current (5.5 amps) 0.55 volts will be dropped across the sense resistor.

The sensed current is summed with a slope compensation signal controlled by the programmable logic device as will be described in greater detail subsequently. The summed signal is provided to the regulator on the ISEN input. The regulator circuit provides a comparator having an internal precision one volt reference. In addition, the regulator contains an internal set/reset (SR) flip flop. The internal comparator provides a low output while the signal received on ISEN is below 5.5 amps. When this signal rises above 5.5 amps the comparator output transitions high providing an input to the reset of the SR flip flop causing the flip flop output to transition to a low signal. This low signal is output from the regulator on terminal OUT through a filter formed by capacitor 660 and resistor 662 to the CA input of the programmable logic device. The CA signal as previously described enables the output of the PHA and PHB signals from the programmable logic device.

When the ISEN input to the regulator indicates a decaying current the internal comparator output will transition high. However, the SR flip flop will remain in the low condition until a signal is received on the R/C input of the regulator to provide a set signal to the flip flop. The ABRST signal from the programmable logic device provides this set signal for the regulator.

The slope compensation for the A and B phases in regulator 630 is provided under control of the ABRMP signal from the programmable logic device. Upon assertion of the ABRMP signal, capacitor 664 is charged through resistor 666 driving the base of transistor 668 producing a ramp signal at the emitter. The emitter output provided through resistor 670 is the slope compensation signal summed with the A&BSENSE signal. When the ABRMP signal pulses low, as shown in FIG. 10, capacitor 664 is discharged through diode 672 resetting the compensation signal to 0. A common ground signal connected to system ground is provided for the motor driver circuitry of the A and B phases through connection ABG. This system ground is provided for use by the comparator through input VSB in the regulator and is employed in filtering the ISEN input to the regulator through capacitor 674.

Regulation of the current for the C and D phases is accomplished similarly using regulator 632. Current for the C and D phases is sensed as signal C&DSENSE provided through resistor 676. Operation of regulator 632 is identical to regulator 630 and an output is provided on terminal OUT as the CB signal for the programmable logic device. This signal is filtered through capacitor 678 and resistor 680. Slope compensation is provided through transistor 682 using the CDRMP signal from the programmable logic device with charging of the transistor through resistor 684 and capacitor 686 with discharge through diode 688. The slope compensation signal is provided through resistor 690 for summing with the C&DSENSE signal. A system ground is provided for the C and D phase componentry through terminal CDG with filtering of the ISEN input of the second regulator through capacitor 691.

As a final control function for the motor driver, the programmable logic device provides snubber control for the switching transistors in the motor driver. The programmable logic device provides a control signal on output SNBR to transistor 692 which switches the constant current source provided by transistor 694. The switched current charges capacitor 696 which carries the signal to the primary winding of transformer 698. The secondary of transformer 698 provides connections for the SNUBBER GATE and SNUBBER SOURCE signals which will be described in greater detail subsequently. The actual voltage of the snubber (SNUBBER VOLTAGE) is sensed through amplifier 699 and provided to the programmable logic device at the SNBOFF input. A low state for the SNUBBER VOLTAGE signal confirms a snubber off condition for the programmable logic device as previously described with regard to FIG. 9.

As previously described with regard to FIG. 5, the motor voltage provided to the stepper motor is sensed and returned to the controller as the MTRV signal. The MTRV signal is converted in the controller to a VSS input for amplifier 697 for comparison to a precision voltage source as a low voltage detector. The output of amplifier 697 is provided to the micro-controller 610 through input VLOW in port 1. A low motor voltage will preclude operation of the system in a degraded state.

12 volt and 5 volt power input for the controller is provided on the +12 V and +5 V terminals on the controller from the auxiliary power supply as previously described with regard to FIG. 5. The 12 volt supply and 5 volt supply are filtered through capacitors 640 and 642 respectively. For simplification of FIG. 6 filtering of voltage inputs to the various ICs and circuits, compensation structures for the amplifiers, various pullup resistors for the internal signals, and clamping diodes where appropriate are not shown. Those skilled in the art will recognize proper implementation of these elements as required. Cable connections for the control signals between the controller and driver are provided through cable 518 of FIG. 5 as previously described. Inter connections for cable 518 between the controller and motor driver are labeled J1 through J9 on FIGS. 6 and 11 for reference.

Figure 11:
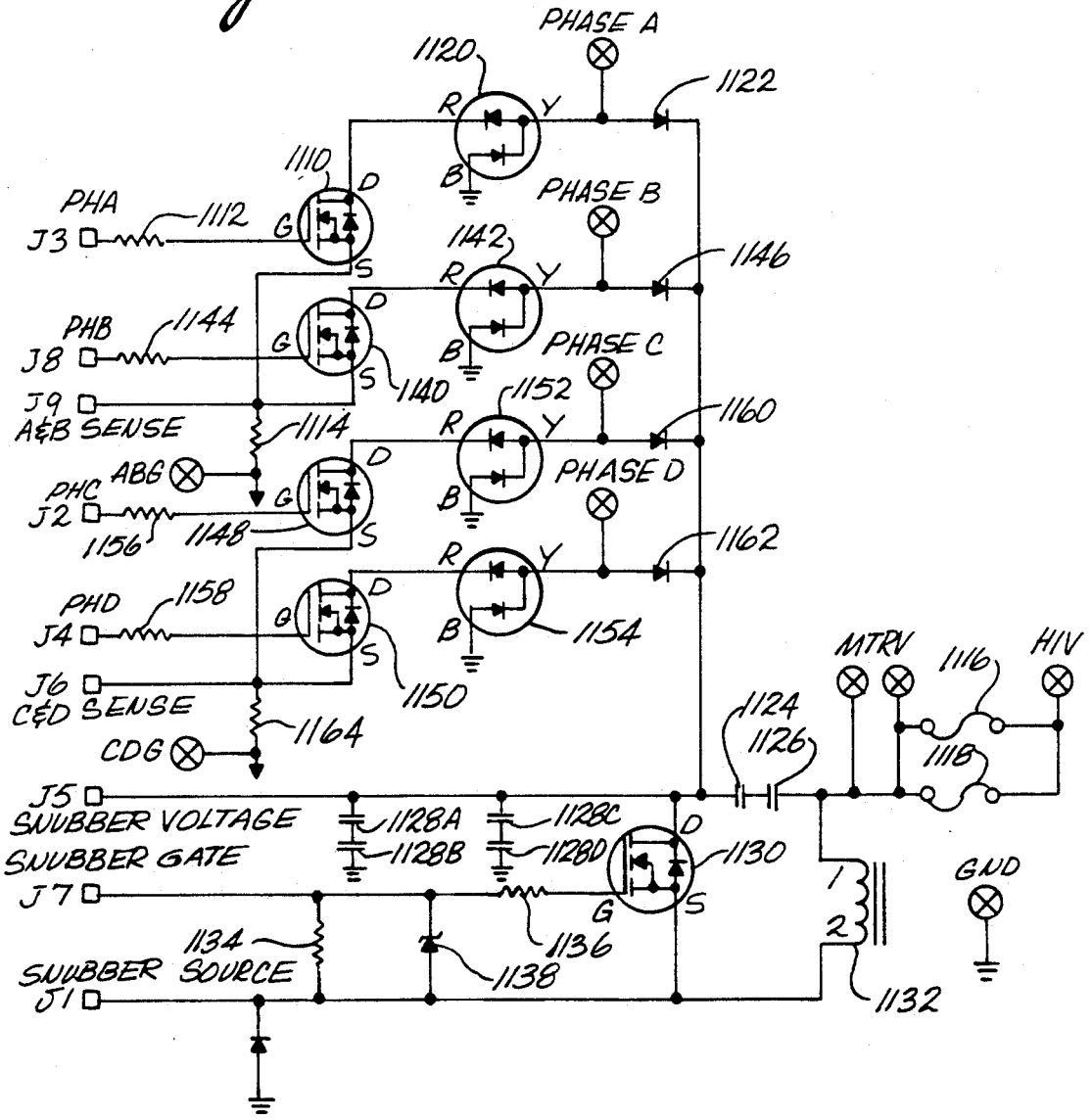
FIG. 11 is a detailed schematic of the stepper motor FET module.

The motor driver is contained in a step motor FET module described in detail in FIG. 11. As previously described the step motor FET module (SMFM) is contained on a separate circuit board for thermal and repairability considerations. For each motor phase the SMFM contains a separate switching circuit including FETs a switching transistors and current steering diodes. Using the phase A circuit as an example, the PHA signal from the controller is received as the gate input to FET 1110 through resistor 1112. When PHA is asserted, FET 1110 is switched on allowing current to flow from the phase A winding of the motor through terminal PHASE A. Current flowing through FET 1110 to the system ground at terminal ABG flows through sense resistor 1114 providing the A&BSENSE signal to the controller. As previously described voltage for the motor MTRV is provided from the generator through input HIV. Power input for the motor voltage is fused using fuses 1116 and 1118. The operating motor voltage is monitored through terminal MTRV at the controller as previously described. When the PHA signal goes low FET 1110 is switched off. As the magnetic field begins to collapse the blocking diode in diode pair 1120 prevents current from flowing through the FETs internal diode. The steering diode in pair 1120 allows current to flow past the sense resistor 1114 during the other common phase.

The high voltage spike generated by leakage inductance when motor phase A is switched off is snubbed through diode 1122. The energy is stored in capacitors 1124 and 1126. The voltage on the capacitors is monitored by the SNUBBER VOLTAGE signal which is buffered by capacitors 1128A through 1128D. The SNUBBER GATE and SNUBBER SOURCE signals, provided by the programmable logic device of the controller as previously described with respect to FIG. 6, switch on FET 1130 to discharge capacitor 1124 and 1126 through choke 1132 back to the power voltage. Bias resistor 1134 and source resistor 1136 calibrate FET 1130 for proper switching. Zener diode 1138 provides surge protection.

Phase B operates identically to phase A employing FET 1140 diode pair 1142 Gate resistor 1144 and snubber diode 1146. Phases C and D operate identically to phases A and B using FETs 1148 and 1150 with diode pairs 1152 and 1154, gate resistors 1156 and 1158, snubber diodes 1160 and 1162, and sense resistor 1164. System ground for the C and D phases is provided on terminal CDG as previously described.

Having described the elements of the controller and motor driver, operation of the system may be described as follows: the default valve position profile is selected by the operator using the jumpers for the MODES inputs to the micro-controller as previously described. The down hole processor may then select on a real time basis one of the seven valve position profiles for each operation of the valve. Once a valve position profile is selected the DRIVE input is cycled by the down hole processor. A transition of the DRIVE input without cycling selects the default profile. The valve position profile determines the rate the valve opens, the distance it opens, how long it is open, and the rate at which it closes.

For each valve position profile as previously described, two modes of operation may be initially selected by the user employing the fourth jumper for the MODES input as previously described. The first mode of operation or pulse mode causes the valve to open then immediately close whenever the DRIVE signal from the down hole processor is held at zero volts for more than 100 milliseconds. The second or open/close mode of operation causes the valve to open following the selected valve position profile when the drive signal is at zero volts for more than 100 milliseconds. The valve remains held open with current applied to the motor face windings to provide holding torque for as long as the drive signal remains 0 volts. The valve closes following a selected position profile when the DRIVE signal transitions back to +5 volts. Upon receiving the appropriate DRIVE signal and assessing the various DRIVE inputs and MODES selections, the micro-controller determines if the high voltage winding of the generator is supplying adequate voltage to drive the motor by sensing on the VLOW input as described with respect to FIG. 6. If there is not adequate voltage to drive the motor the command to open the valve is ignored. If adequate voltage is present, the micro-controller will switch on power to the motor using the MOFF signal and commence execution of the selected valve profile to open, hold as necessary, and close the valve.

Valve position is determined by the number of steps executed by the motor. The micro-controller outputs the number of steps using the step signal to the programmable logic device. The direction of stepping to open the valve is controlled by the micro-controller using the DIR signal as previously described. The number of steps required to open the valve to the appropriate position per the profile is stored in the read only memory accessed by the micro-controller. Additionally, delays between steps to meet the acceleration and velocity requirements of the profile are stored in the memory and read by the micro-controller to determine appropriate timing of the STEP signals. Phase switching of the stepper motor itself is accomplished using the PHA, PHB, PHC, and PHD outputs from the programmable logic device driving the FETs in the SMFD to provide the phase A, phase B, phase C, and phase D current to the motor as previously described.

The availability of a plurality of valve positioning profiles accessible in a real time environment allows the down hole processor to optimize operation of the pulser valve for sensed conditions. Various profiles selectable based on consistency of the drilling fluid, the amount of LCM present, the actual transmission efficiency of the signals as detected down hole by a transducer for closed loop control, and numerous other parameters may now be dynamically compensated for to achieve the best possible data transmission from the down hole system.

Having now described the invention in detail, as required by the patent statutes, those skilled in the art will recognize modifications and substitutions for elements of the embodiment disclosed. Such substitutions and modifications fall within the intent and scope of the present invention as defined by the following claims.

We claim:

1. A pressure pulse generator for sending information to a surface pressure pulse detector through drilling fluid in a bore hole, the generator comprising:

a valve assembly having a poppet and a seat, the poppet variably displaceable from the seat along an axis, the seat and poppet meeting at an interface when closed, the seat intermediate an inlet port of the valve in communication with high pressure drilling fluid in the drill string and an exit nozzle from the valve in communication with low pressure drilling fluid in the well bore;

a stepper motor having an output shaft, the motor providing stepped rotary motion through the shaft in a selectable direction;

means interconnecting the output shaft and the poppet for converting rotary motion of the shaft to axial motion of the poppet; and, an electronic control means connected to the stepper motor for selecting the direction, number of steps, and timing of steps by the motor to displace the poppet from the seat to a variable position with variable acceleration.

2. A pressure pulse generator as defined in claim 1 wherein the electronic control means comprises:

a motor controller receiving a drive signal and having means for interpreting the drive signal, memory means responsive to the interpreting means for providing a valve position profile, means for providing step signals responsive to the position profile, means for providing a direction signal responsive to the position profile, and means for generating motor control signals responsive to the step signal and direction signal; and, a motor driver means responsive to the motor control signals and connected to the stepper motor for driving the stepper motor.

3. A pressure pulse generator as defined in claim 2 wherein the means for generating motor control signals comprises phase signal generation means for generating a plurality of timed switching signals; and, wherein the motor driver means comprises a plurality of switching transistors responsive to the plurality of switching signals and connected to the stepper motor to provide motor phase current.

4. A pressure pulse generator as defined in claim 3 wherein the motor controller further includes means for generating a motor on/off signal and the means for generating motor control signals is enabled by the motor on/off signal.

5. A pressure pulse generator for sending information to a surface pressure pulse detector through drilling fluid in a bore hole, the generator comprising:

a valve assembly having a poppet and seat, the poppet variable displaceable from the seat along an axis, the seat and poppet meeting at an interface when closed, the seat intermediate an inlet port of the valve in communication with high pressure drilling fluid in the drill string and an exit nozzle from the valve in communication with low pressure drilling fluid in the well bore;

a stepper motor having an output shaft, the motor providing stepped rotary motion through the shaft in a selectable direction;

means interconnecting the output shaft and the poppet for converting rotary motion of the shaft to axial motion of the poppet;

a motor controller receiving a drive signal and having means for interpreting the drive signal, memory means responsive to the interpreting means for providing a valve position profile, means for providing step signals responsive to the position profile, means for providing a direction signal responsive to the position profile, means for generating a motor on/off signal, and means for generating motor control signals responsive to the step signal and direction signal, the means for generating motor control signals enabled by the motor on/off signal; and, a motor driver means responsive to the motor control signals and connected to the stepper motor for driving the stepper motor.

6. A pressure pulse generator as defined in claim 1 wherein the valve further comprises means for urging the poppet against the seat.

7. A pressure pulse generator as defined in claim 6 wherein the means for urging the poppet comprises:

a chamber surrounding an end of the poppet opposite the interface for receiving high pressure drilling fluid;

a sealing means intermediate the chamber and the seat on the poppet, the sealing means having a diameter greater than the interface between the poppet and seat; and, wherein the poppet includes an axial bore therethrough for communicating pressure of the high pressure drilling fluid to the chamber.

8. A negative pressure pulse generator as defined in claim 2 wherein the drive signal is provided by a down hole processor unit.

9. A system for transmitting down hole drilling data, the system mounted in a drill string in a well bore with a pressurized drilling fluid flowing through the drill string and into the well bore, the system comprising:

a pressure transducer monitoring pressure of the drilling fluid in the drill string;

down hole sensors for obtaining drilling data mounted in the drill string;

a down hole processor receiving data input from the down hole sensors and providing a drive signal representative of selected data;

a valve assembly having a poppet and seat, the poppet variably displaceable from the seat along an axis, the seat and poppet meeting at an interface when closed, the seat intermediate an inlet port of the valve in communication with high pressure drilling fluid in the drill string and an exit nozzle from the valve in communication with low pressure drilling fluid in the well bore;

a stepper motor having an output shaft, the motor providing stepped rotary motion through the shaft in a selectable direction;

means interconnecting the output shaft and the poppet for converting rotary motion of the shaft to axial motion of the poppet;

a motor controller receiving a drive signal and having means for interpreting the drive signal, memory means responsive to the interpreting means for providing a valve position profile, means for providing step signals responsive to the position profile, means for providing a direction signal responsive to the position profile, means for generating a motor on/off signal, and means for generating motor control signals responsive to the step signal and direction signal, the means for generating motor control signals enabled by the motor on/off signal; and, a motor driver means responsive to the motor control signals and connected to the stepper motor for driving the stepper motor.

* * * * *